United States Patent [19]

Winyard

[11] Patent Number: 5,018,952

[45] Date of Patent: May 28, 1991

[54] SINGLE SCREW MECHANISM WITH GATEROTOR HOUSING AT INTERMEDIATE PRESSURE

[75] Inventor: David C. Winyard, Annapolis, Md.

[73] Assignee: The United States of America as represented by the Secretary of the Navy, Washington, D.C.

[21] Appl. No.: 359,462

[22] Filed: May 31, 1989

[51] Int. Cl.[5] ..... F04C 18/12; F04C 23/00

[52] U.S. Cl. ..... 418/195; 418/196

[58] Field of Search ..... 418/195, 196

[56] References Cited

U.S. PATENT DOCUMENTS

| | | | |
|---|---|---|---|
| 4,105,378 | 8/1978 | Hodge | 418/195 |
| 4,153,395 | 5/1979 | O'Neill | 418/9 |
| 4,293,291 | 10/1981 | Link | 418/104 |
| 4,321,022 | 3/1982 | Zimmern | 418/195 |
| 4,373,881 | 2/1983 | Matsushita | 418/195 |
| 4,824,348 | 4/1989 | Winyard | 418/195 |

FOREIGN PATENT DOCUMENTS

| | | | |
|---|---|---|---|
| 2833292 | 2/1979 | Fed. Rep. of Germany | 418/195 |

*Primary Examiner*—Leonard E. Smith
*Assistant Examiner*—David L. Cavanaugh
*Attorney, Agent, or Firm*—Luther A. Marsh; Sol Sheinbein

[57] ABSTRACT

The present invention is an improvement upon conventional single-screw mechanisms in that the gaterotor housing is substantially isolated from both the inlet and outlet port areas by a window opening path through the casing whereby the gaterotor teeth pass for engagement with the mainrotor. The window path has been extended and has close clearances provided on both sides of the entering gaterotor teeth creating two barriers to internal leakage thereby reducing window path losses, increasing volumetric efficiency and allowing higher pressure capability.

4 Claims, 4 Drawing Sheets

SINGLE SCREW MECHANISM WITH GATEROTOR HOUSING AT INTERMEDIATE PRESSURE

The invention described herein may be manufactured and used by or for the Government of the United States of America for governmental purposes without the payment of any royalties thereon or therefor.

BACKGROUND OF THE INVENTION

1. Field of the Invention

The present invention relates to an improvement in single-screw mechanisms of various types meant to vary the pressure of a fluid such as a liquid pump, gas compressor or expander, hydraulic motor, or the like.

2. Description of the Prior Art

The group of single-screw mechanisms which is of concern to the present invention are classified as positive-displacement rotary type machines. This invention relates to single-screw mechanisms that utilize, by way of example but not by way of limitation, planar, conical, cylindrical, toroidal, or other mainrotor shapes typically with cylindrical or planar gaterotors. In machines of this type, there is one mainrotor with a plurality of spiral threads that is driven by prime mover means so as to spin about a fixed axis within a fluid-tight stationary casing. There is at least one and usually two gaterotors, which are symmetrically disposed substantially transverse to the axis of the mainrotor, whose teeth penetrate through an opening in the machine's casing, called a window path, for meshing engagement with the threads of the mainrotor. The casing is provided with inlet and outlet ports for connecting the interior of this mechanism respectively to an intake and discharge plenum. The gaterotor teeth sweep the mainrotor threads drawing fluid into the mainrotor groove chamber from the inlet port and forcing the entrapped fluid from the thread groove into an outlet port provided in the casing. Sufficient torque is supplied by the prime mover means for rotation of the mainrotor towards the gaterotor tooth to overcome the discharge pressure being generated in the closed pocket of fluid defined in the groove chamber between the machine casing, mainrotor threads and gaterotor tooth.

Current practice in utilizing the single-screw mechanism as a pump or compressor has provided a single gaterotor tooth to seal off individual mainrotor grooves, thereby separating the higher pressure fluid from the intake side or inlet pressure. This single tooth must fit very closely to the mainrotor threads in order to minimize internal leakage and withstand the differential pressure forces applied to the opposite sides of the gaterotor tooth. Formerly, these factors have made it necessary to use a two part gaterotor comprising conforming nonmetallic gaterotor teeth each of which are backed by metallic supports on the low pressure side to provide adequate tooth stiffness. Supported gaterotor teeth are well known in the preceding art and are required in conventional single-screw mechanisms for operation at high differential pressures.

In the prior art, the inclusion of these metallic stiffeners has allowed the free flow of low pressure fluid between areas of the machine open to the inlet port and the gaterotor housing. This practice has persisted, especially where high outlet pressures are desired, in order to accommodate the use of the required metallic stiffener on the low pressure side of a nonmetallic gaterotor tooth. As these stiffeners are not conformant to the mainrotor thread, wide window pathways must be provided in the casing in order to permit mainrotor-gaterotor engagement. The presence of this nonconforming metallic stiffener thus permits a large area for the leakage of low pressure fluid leading from the low pressure side of the tooth and the low pressure inlet port into the gaterotor housing as can be seen in FIG. 3 at 14 and 15.

Problematically, in machines of the aforementioned design, unless the build up of fluid in the gaterotor housing is allowed to flow uninhibitedly back into the vicinity of the low pressure port, the pressure in the gaterotor housing will become elevated. Currently, gaterotor housing enclosures are designed to resist no more than low internal pressure, and as the inlet opening at 15 in FIG. 3 partially restricts fluid communication between the gaterotor housing and the inlet port area, present practice requires provision for "bleeding" off the fluid flowing into the gaterotor housing.

Numerous notable attempts have been made in the past to increase mechanical and volumetric efficiencies of these machines by limiting the presence of the many internal leakage paths that exist. Efforts to accomplish this end have included providing additional seals, reducing clearances, recapturing fluid leakage, changing mainrotor-gaterotor configurations and using various other techniques. By way of example, U.S. Pat. No. 4,105,378 reduces flow past the mainrotor band leakage path by locating a radially extending seal on the mainrotor closely adjacent to one end of the housing. U.S. Pat. No. 4,321,022 reduces flow past the gaterotor flank leakage path by utilizing gaterotor teeth flanks comprising at least three skewed surfaces which intersect on at least two edges so as to provide dual lines of sealing with the mainrotor thread. In U.S. Pat. No. 4,373,881, a conical mainrotor having a plurality of helical screw threads is engaged with a cylindrical gaterotor for increased outlet fluid volume by way of increasing the contact length and depth of each gaterotor tooth with each mainrotor groove. However, until recent developments have made it possible, sealing the gaterotor window leakage path has remained basically unaddressed except on the leading or high pressure side of the gaterotor teeth.

While some current single design configurations are capable of using self-supported gaterotors for low pressure applications (operation generally less than 150 psi outlet), common practice is to retain the use of gaterotor teeth stiffeners even when it unnecessary. However, several novel single-screw mechanisms have recently been introduced which obviate the need for metallic stiffeners where either high or low discharge pressures are required in a single stage. As exemplified in the co-pending U.S. Patent Application Ser. No. 07/287,352, filed Dec. 21, 1988, T. Bein discloses a single-screw compressor or expander comprising a compound conical mainrotor with cylindrical gaterotors wherein the inclusion of a hydrostatic type pressure port on the inlet side of the window path opening makes it possible to use a gaterotor tooth which has less or no need for additional structural support by way of backup stiffeners. In addition, the Inventor's U.S. Pat. No. 4,824,348, filed Aug. 27, 1986, discloses a multiple tooth engagement single-screw mechanism wherein several teeth are simultaneously engaged in each mainrotor thread. The advantage of this design is that it breaks down the high to low pressure gradient across two or more gaterotor teeth engaged in a single mainrotor thread groove and therefore allows use of gaterotor teeth which are self-supporting.

SUMMARY OF THE INVENTION

This invention is an improvement upon the conventional single-screw mechanism in accordance with which the gaterotor housing is substantially isolated from both the inlet and outlet ports of a single-screw compressor, expander, pump or motor by strengthening and conforming the gaterotor housing boundary walls to the outer peripheral surface of the gaterotor and by providing an extended double-sided window opening path. The window path opening, which permits the gaterotor teeth to engage with the mainrotor through the casing, is milled at a close clearance to a self-supported gaterotor tooth thickness on both the low and high pressure sides of the teeth and is extended in length. Increasing the length of the window path opening to a position before the point of gaterotor entrance into the mainrotor and after the point of exit from the mainrotor is sufficient to prevent the free flow of fluid between either the inlet or outlet ports and the gaterotor housing. Leakage from the high pressure side of the gaterotor teeth through the window path opening increases the pressure in the gaterotor housing to a level intermediate between the inlet and discharge pressures. By so pressurizing the gaterotor housing, fluid loss at the window path opening is reduced and a pressure-driven gaterotor is introduced.

Accordingly, it is an object of this invention to provide single-screw mechanisms wherein the gaterotor housing is substantially separated from both the inlet and outlet ports.

It is also an object of this invention to provide single-screw mechanisms wherein window path leakage is reduced by decreasing the pressure differential between the discharge chambers and the internal pressure in the gaterotor housing.

It is a further object of this invention to provide single-screw mechanisms which raise the mechanical and volumetric efficienies and demonstrate improved operation on fluids, especially at the higher pressure gradients, when compared with the prior art.

BRIEF DESCRIPTION OF THE DRAWINGS

In the figures, like reference numerals designate like or corresponding components throughout the several views.

DETAILED DESCRIPTION OF THE INVENTION

Figure 1:
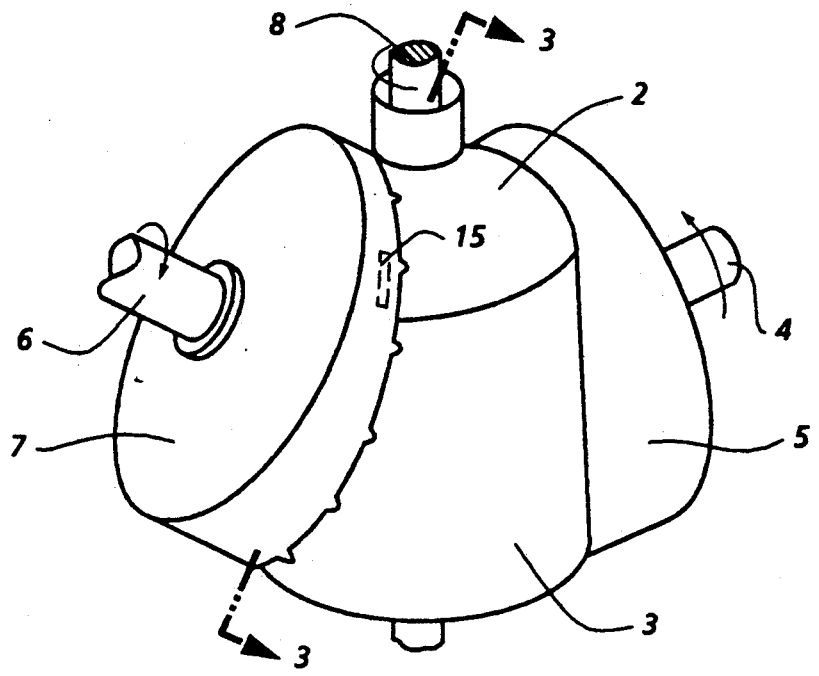
FIG. 1 PRIOR ART
FIG. 1 is a perspective view of a conventional single-screw machine enclosure with one mainrotor and two transversely opposed gaterotors.
Figure 2:
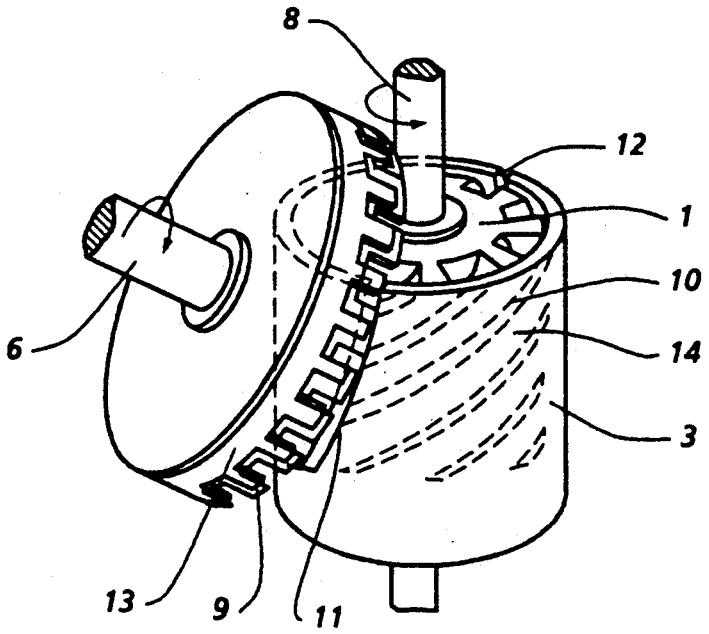
FIG. 2 PRIOR ART
FIG. 2 is a perspective view of the same conventional single-screw mechanism as in FIG. 1 with the top of the mainrotor casing, one gaterotor and both gaterotor housings removed showing the remaining gaterotor engaged with the mainrotor through a window opening path.
Figure 3:
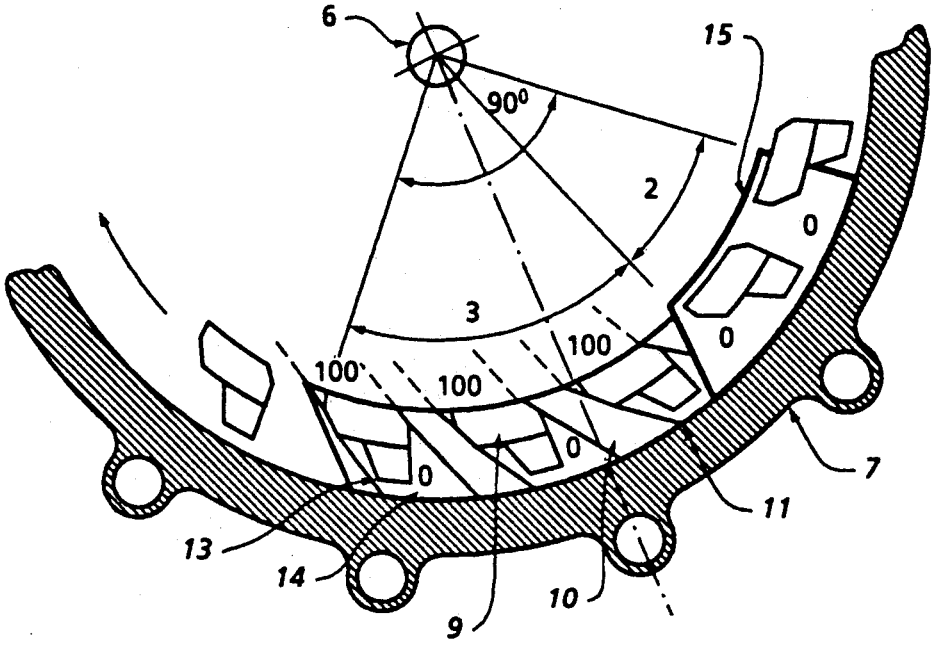
FIG. 3 PRIOR ART
FIG. 3 is a cross section from FIG. 1 through the gaterotor housing showing the window path and inlet openings of the prior art in plan view.

The construction of single-screw mechanisms will be more readily understood from the following description of one prior art embodiment as illustrated in FIGS. 1, 2, and 3. Referring now to FIGS. 1 and 2, the present mechanisms for varying the pressure of a fluid, such as a pump or compressor, are characterized by prime mover means (not shown) which drives the shaft 8 of, in this example, a cylindrical mainrotor 1 within a stationary casing 2 and 3 wherein casing component 3 has a bore symmetry which surrounds and is configured to cooperate in a substantially fluid-tight manner with the surface of revolution of the crests of the mainrotor 1. In accordance with convention, two cylindrical gaterotors 4 and 6 are transversely mounted in housings 5 and 7 at mutually opposed positions with respect to the fixed spin axis of the mainrotor 1. The path opening 15 whereby gaterotor 5 first enters the mainrotor cavity through casing component 2 is shown dashed behind housing piece 7. Casing component 2 is also fitted with an inlet port for the admission of fluid. The outlet port for the discharge of the changed-pressure fluid (not shown) is located in close proximity whereat each gaterotor exits from engagement with the mainrotor 1.

As can be seen more clearly in FIG. 2, wherein the top of the mainrotor casing 2, gaterotor 4 and gaterotor housings 5 and 7 have been removed from FIG. 1, gaterotor 6 is oriented so as to permit engagement between the gaterotor teeth 9 and groves 14 of thread 10 through milled slots 11 and 12 (opposite) in the outer face of the mainrotor casing 3 called window opening paths. The rotatably mounted gaterotor 6 is disposed so as to expose the trailing side of each gaterotor tooth 9 face, in meshing relation with the mainrotor thread 10 grooves 14, to the inlet fluid pressure during rotation. During engagement, substantially fluid-tight clearances must be maintained between the leading face of the gaterotor tooth 9, the mainrotor thread 10 groove 14, the interior of mainrotor casing 3 and the window path opening on the leading gaterotor tooth side in order to define chambers for the changed-pressure fluid therein.

For a liquid machine such as a pump, the volumes of the chambers swept by the enclosing gaterotor teeth are kept equal so as not to compress an incompressible fluid. For a gas machine such as a compressor, or in a similar reverse manner an expander, the cross sectional areas of the formed mainrotor grooves typically decrease from inlet to outlet so that the chamber volume swept by the enclosing gaterotor tooth decreases so as to compress. In order to provide adequate strength for the engaged gaterotor teeth, especially in situations where a high differential exists between the inlet and outlet pressures, nonmetallic gaterotor teeth of the prior art have utilized an annular ring of dependent metal stiffeners 13 attached to the toothed outer peripheral surface of the gaterotor 6.

FIG. 3 is a cross section through the gaterotor housing 7 of the prior art machine of FIG. 1, showing a plan view of the gaterotor 6 as it engages with mainrotor 1. In this view, it can be seen that the gaterotor teeth 9 rotate from the interior of the gaterotor housing 7, through milled slot at the path opening 15 in piece 2 before engagement with the mainrotor thread grooves 14 through the window opening path 11 cut in casing piece 3. The arc described from the center of gaterotor 6 to midline of pathways 11 and 15 generally may be combined for a 90 degree total angle. The width of these arcoid shaped openings in the mainrotor casing must be sufficient to accommodate the cross sectional thickness of the gaterotor teeth. Present practice allows for the presence of the dependent metal gaterotor teeth stiffeners 13 on the inlet or low pressure side of each gaterotor tooth 9. In FIG. 3, the inlet side of the gaterotor 6 teeth 9 is indicated by the numerals 0 (zero) which hereinafter designate the location and pressure condition of the fluid as a percentage of the differential pressure above inlet. Metallic stiffeners 13 are required in order to provide adequate structural strength to conventional nonmetallic gaterotor teeth 9 which must withstand high differential pressures across the gaterotor tooth face during operation.

Accordingly, provision can currently be made for a minimum clearance only between that portion of casing 3 which is located on the high pressure side of the window opening path 11 and the leading face of the gaterotor teeth 9. The clearance which is provided on the low pressure side or trailing face of the gaterotor teeth 9 at the window opening path 11 has no close tolerance due to presence of the nonconforming gaterotor tooth stiffeners 13. In FIG. 3, the high pressure side of the gaterotor 6 teeth 9 is indicated by the dashed numerals 100 (one hundred) located in the mainrotor thread 10 chamber grooves 14 inside the mainrotor casing 3 between the leading face of gaterotor teeth 9 and the outlet port. In a pump configuration meant to perform at an operational ratio (outlet to inlet) of 2 to 1, high pressure fluid would be present at 100 precent of the differential pressure above inlet at all stages. That is, for a 2 to 1 ratio pump of the prior art, having an inlet pressure of 60 psi, the outlet pressure would be 120 psi, and the absolute pressure differential would be 60 psi. In such a device, the internal pressure of gaterator housing 7 also be at 60 psi, as would the pressure differential at the window opening path 11, since gaterator housing 7 is essentially open to the free flow of inlet fluid from the low pressure inlet area above the mainrotor 1 through path opening 15 and from the low pressure side of the gaterotor teeth through window opening 11.

It should also be recognized from FIGS. 2 and 3, that the gaterotor 6 intertooth root areas, which are not fully engaged with mainrotor threads 10 in window opening 11, provide a leakage path for the flow of fluid as they are drawn into gaterotor housing 7. Further, from FIG. 3, it should be observed that the large area at path opening 15 through casing piece 2 where the gaterotor 6 is not engaged with the mainrotor, provides a path for the flow of leakage fluid from the gaterotor housing 7 back to the inlet area above the mainrotor 1 cylinder. Thus, while the prior art has been successful in separating the gaterotor housing from the discharge chamber fluid, the necessity of providing clearance for entry of gaterotor teeth 9 with combined metallic backup stiffeners 13 has prevented designers from sealing the gaterotor housing from the inlet area fluid. The present invention departs from past practice in that the gaterotor housing 7 enclosure is substantially isolated from both the inlet and the outlet parts.

This has been accomplished by utilizing recent developments in single-screw technology by the Inventor in U.S. Pat. No. 4,824,348, and others, which now allow the use of self-supported gaterotors in either high or low discharge pressure applications. The present invention, as previously explained in the Background section of this disclosure, pertains to all such mainrotor-gaterotor configurations as will permit the use of self-supported gaterotor teeth. The improvement thereto comprises a novel opening path wherein close clearances are provided on both the high and low pressure of the entering self-supported gaterotor teeth along an extended length. This new double-sided opening can be seen in FIG. 4, which is a plan view of the gaterotor housing 17 taken from a cross section of FIG. 5 similar to the plan view of FIG. 3 taken from FIG. 1.

Figure 4:
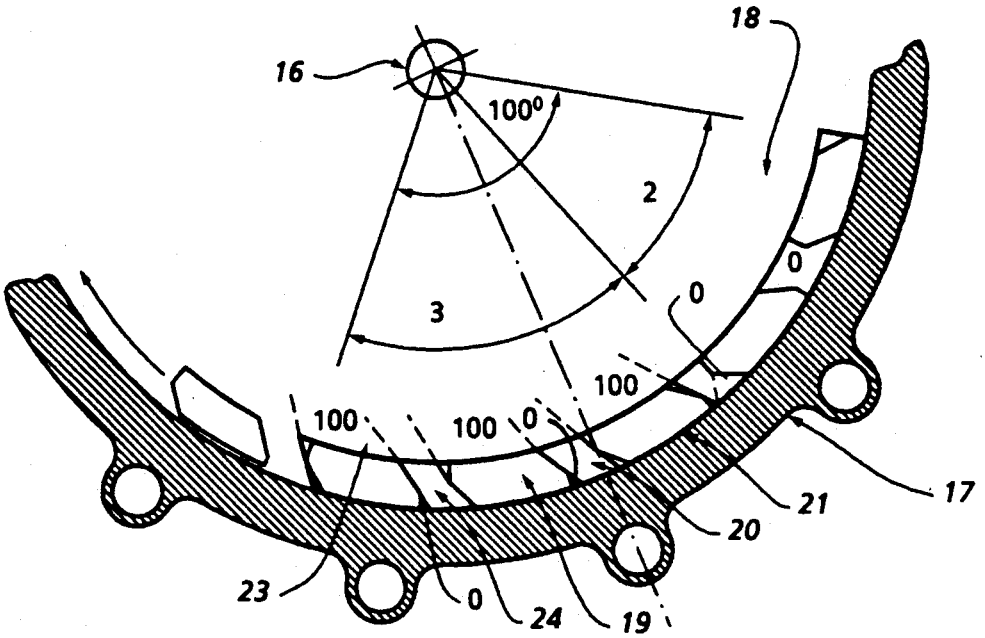
FIG. 4 is a cross section similar to FIG. 3 through the gaterotor housing of FIG. 5 showing the new double-sided window opening and path extension in plan view.

The gaterotor 16 depicted in FIG. 4 utilizes gaterotor teeth 19 which are not supported by an annular ring of dependent metal gaterotor teeth stiffeners as are the gaterotor teeth shown in FIG. 3. In the embodiment of the present invention shown in FIGS. 4 and 5, arcoid path opening 18 through casing piece 2 and arcoid path opening 21 through casing piece 3 are designed with minimum clearances on both the high and low pressure sides of the entering self supported gaterotor teeth 19. The relatively narrow width of pathways 18 and 21 should be readily apparent when compared with the similar pathways 11 and 15 of FIG. 3. These double-sided window openings, having close tolerances to both sides of the gaterotor tooth 19 thickness, substantially prevent the flow of either the high or the low pressure fluid from the interior of the mainrotor casing into the housing, thus isolating gaterotor housing 17.

The present invention, which utilizes self-supported gaterotor teeth in order to create dual sided opening seals at 18 and 21, also provides for extension of these double-sided windows far enough on one or both sides, depending upon the mechanism configuration, of the path of tooth insertion into the mainrotor so as to additionally constrain leakage flow into gaterotor housing 17. In the FIG. 4 embodiment, the new double-sided window pathways form an arc through casing pieces 2 and 3, which when combined, total approximately a 100 degree angle. This should be compared with the 90 degree total arc angle common in the prior art as can be seen in FIG. 3. This pathway extension further limits flow, primarily from the inlet port area, into the gaterotor housing 17 to either that which is carried into or out of it by way of the gaterotor intertooth volume or that which leaks into it from both sides of the gaterotor teeth 19 between the close clearances provided at 18 and 21.

It should be recognized however, that the dual sided seal and extension of this window pathway also prevents the free flow of fluid from the gaterotor housing 17 back into the inlet area above the mainrotor 1 cylinder. As a consequence of this flow restriction out of the gaterotor housing 17, the housing enclosure experiences a rise in the internal pressure. Past practice has been to design the gaterotor housing 7 to withstand only low internal pressure requiring provision for "bleeding" off fluid flowing into the gaterotor housing 7. The present invention requires strengthening of the gaterotor housing 17 in order to withstand flows from both the inlet port area and the discharge chambers. The strengthening of gaterotor housing 17 can be seen by comparing its relative thicknesses, in FIG. 4, to that of the similar housing component 7 in FIG. 3. By strengthening and conforming the gaterotor housing 17 boundary walls to the outer peripheral surface of the gaterotor 16, the housing enclosure accomodates this higher internal pressure and substantially isolates it from both the inlet and outlet ports except by way of the double-sided window openings at 18 and 21.

Figure 5:
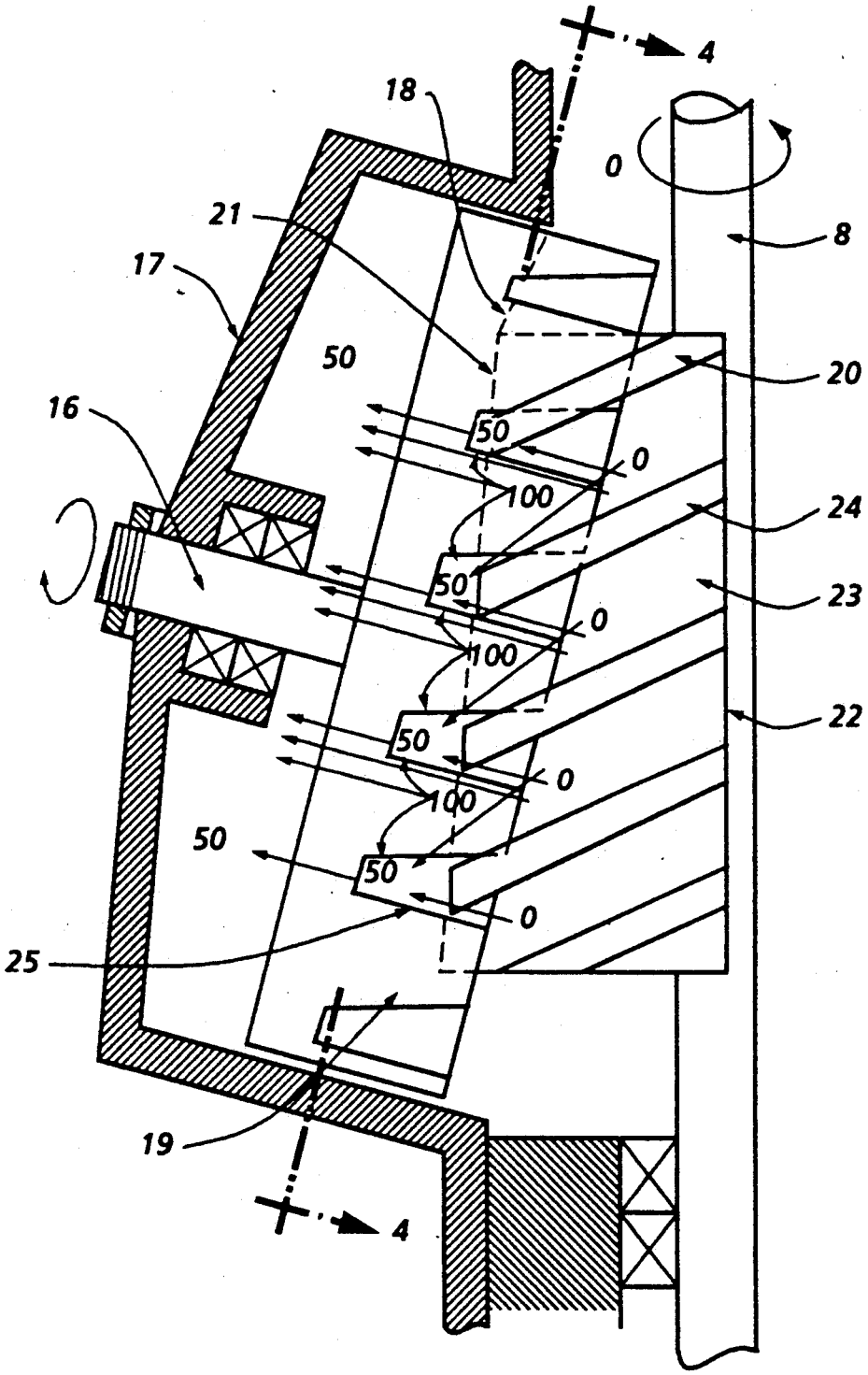
FIG. 5 is a half cross section through the midplane of a single-screw mechanism in accordance with the teachings of the present invention illustrating the effect of gaterotor housing isolation.

Referring now to FIGS. 4 and 5, the mainrotor grooves 23 have indicated therein the presence of fluid correspondingly specified by the numerals 0 (zero) and the dashed 100 (one hundred) which, as previously, designate the location and pressure condition of the fluid as a percentage of it's differential pressure above inlet. In both FIGS. 4 and 5, the high and the low pressure fluids are on opposite sides of the gaterotor teeth 19 after they pass into engagement with the mainrotor 22 through the window opening at 21. The high pressure fluid in both of these figures is located in the mainrotor chamber grooves 23 inside the mainrotor casing 3 between the leading face of the gaterotor teeth 19 and the outlet port. The restriction on flow both into and out of housing 17, due to the dual sided seal and extension of the window path opening, results in an equilibrium pressure being reached inside of the gaterotor enclosure. This equilibrium pressure reaches an intermediate value between the high (discharge) and low (inlet) pressure differential to which the gaterotor teeth 19 sides are exposed during penetration of casing components 2 and 3 through the opening paths at 18 and 21 respectively.

In accordance with the teachings of the present invention, FIG. 5 depicts a half cross section through the midplane of a multiple tooth engagement pump. By way of example, but not by way of limitation, the FIG. 5 device illustrates a single-screw mechanism comprising two symmetrically opposed cylindrical gaterotors 16 (the other is not shown) and a truncated conical mainrotor 22, having two mainrotor threads 20 and 24, with a generally helicoid shape each of which wind around the mainrotor at least one full turn and preferably two or more full turns. The arrows in FIG. 5, demonstrate the general direction of fluid leakage into the gaterotor housing 17. When the FIG. 5 device embodies the aforementioned improvements and is configured to perform at an opertional ratio of 2 to 1, for example, it should be discerned that the internal pressure of gaterotor housing 17 will be elevated to the intermediate pressure of 50 percent above inlet pressure. That is, such a pump device, having an inlet pressure of 60 psi, will have a outlet pressure of 120 psi and a gaterotor housing 17 internal pressure of 90 psi. This should be contrasted with a similar internal pressure reading of 60 psi or 0 (zero) percent above inlet from a FIG. 3 type prior art machine since that 7 housing's internal pressure would be at inlet. This rise in internal gaterotor housing 17 pressure is attributable to retention of the leakage fluid from both the high (discharge) pressure chambers and the low (inlet) pressure port through the double-sided window pathways at 18 and 21. Fluid is also carried into the enclosure by the gaterotor intertooth 25 volume, all of which tend to equalize in the housing 17. This internal pressurization is sufficient to cause a rate of flow out of gaterotor housing 17 towards the inlet port area above the mainrotor 22 through opening path 18.

The increase in internal gaterotor housing pressure, above the inlet pressure of the prior art to an intermediate pressure, has the advantage of reducing leakage flow at the window opening path 21. The flow per unit length between closely spaced parallel plates is described by the following equation:

$$Q/W = -1/12\mu(\Delta P/L)A^3$$

where Q = volumetric flow rate, W = width of window path, $\mu$ = fluid absolute viscosity, $\Delta P$ = pressure differential (discharge minus inlet), L = length of window path, and A = window path clearance. Assuming, in accordance with the above example, a gaterotor housing 17 pressure halfway between the inlet and outlet port pressures, the pressure differential at the window opening path 21 will be halved. That is, for a 2 to 1 ratio pump of FIGS. 4 and 5, with an inlet pressure of 60 psi, the pressure differential at the window opening path 21 equals 30 psi (the discharge pressure of 120 psi minus the internal gaterotor housing 17 pressure of 90 psi). This should be contrasted with a similar pressure differential reading at window opening path 11 from FIG. 3 which equals 60 psi (a discharge pressure of 120 psi minus the internal gaterotor housing 7 pressure of 60 psi). Since the above flow equation is linear with $\Delta P$ for low window differential pressures and long window lengths, the window opening 21 leakage is reduced by 50% in low pressure applications.

For high pressure applications with high window differential pressures and short window lengths, the flow per unit length through the opening path 21 is described by the following equation:

$$Q/W = A2(\Delta P)/\rho$$

where Q, W, $\Delta P$ and A are as previously defined and $\rho$ = fluid density. Since the above flow equation is proportional to the square root of the differential pressure drop, the window opening leakage will be reduced by a factor of:

$$\Delta Q = 1 - \Delta P1/\Delta P2 = 1 - \tfrac{1}{2} = 1.00 - 0.70 = 30\%$$

Thus, in both high and low pressure cases, leakage at the window opening path 21 is dramatically reduced by decreasing the pressure differential between the discharge chambers and the internal pressure of the gaterotor housing 17.

The aforementioned window path opening 21 leakage reductions are similar for a compressor embodiment of FIG. 5, wherein the mainrotor 22 has a substantially cylindrical profile. When this embodiment is meant to perform at a compression ratio (discharge to inlet) of 2 to 1, the high pressure fluid percentages vary between adjacent discharge chambers from, for example, 25 to 50 to 75 above inlet pressure from inlet to outlet, depending upon which stage in the compression cycle each simultaneously sweeping gaterotor tooth is engaged. That is, such a compressor device, having an inlet pressure of 60 psi, will have a discharge pressure of 120 psi, and a gaterotor housing 17 internal pressure which is elevated to 90 psi. This internal pressure, which is halfway between the inlet and outlet port pressures, is achieved due to fluid leakage through paths 18 and 21 from inlet at 60 psi pressure, from adjacent discharge pressures at 75, 90 and 105 psi, and from outlet at 120 psi pressure all of which reach an intermediate pressure in the gaterotor housing 17. Hence, the pressure differential at the window opening path 21 will be 120 minus 90 equal to 30 psi (the discharge pressure of 120 psi minus the internal gaterotor housing 17 pressure of 90 psi) compared with 60 psi for a similar compressor of the prior art. Thus, reductions of 30% and 50% of leakage at the window opening path 21, as hereinbefore specified for high and low pressure pump applications, are correspondingly realized for a compressor embodiment.

Tests confirming these predicted results were conducted at the David Taylor Research Center in Annaplois, Md. on a prototype balanced-rotor single-screw pump of the multiple tooth engagement mechanism disclosed in U.S. Pat. No. 4,824,348 and shown in half cross section in FIG. 5. The test pump had an ideal displacement of 87 gal/min at 1,800 rev/min. Its rated performance on diesel fuel was 72 gal/min under 105 psi outlet, 10 in-Hg inlet, and 1,800 rev/min operating condition. The pump test facility set-up, shown schematically in FIG. 6, permitted variable speed, pressure, and temperature operation.

Figure 6:
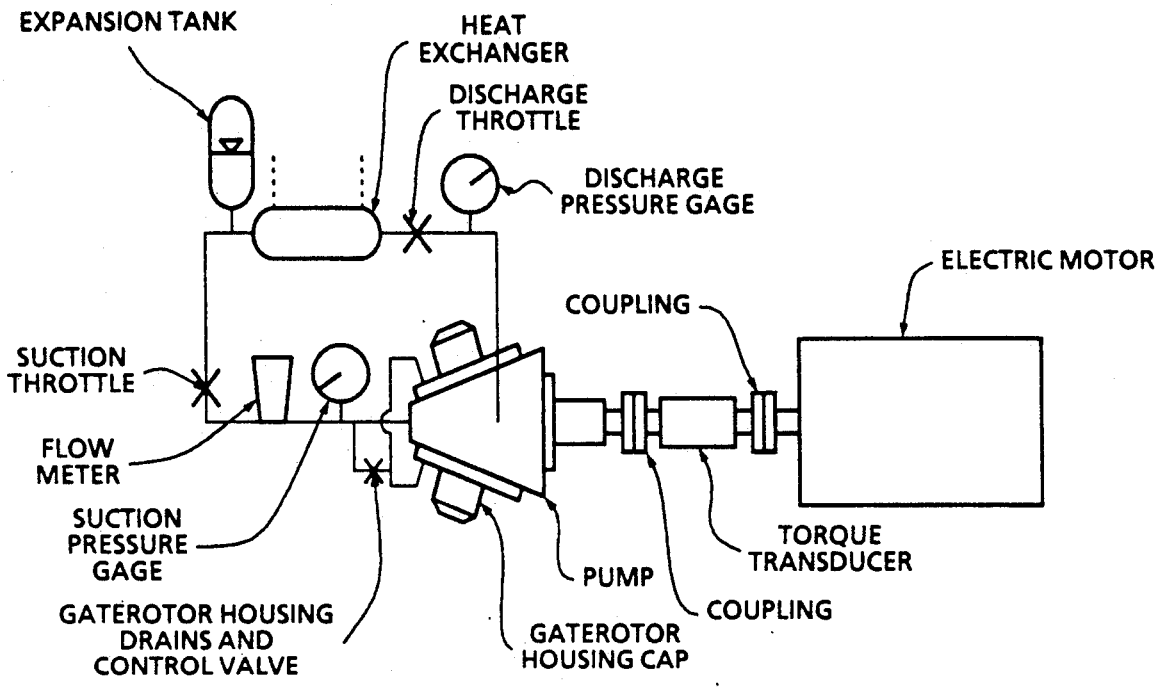
FIG. 6 is a schematic view of the test facility set-up for a balanced-rotor single-screw pump of the multiple tooth engagement type.

In order to demonstrate the overall advantage of gaterotor housing isolation, ¼ inch drain tubes and a control valve were installed connecting the gaterotor housings and the pump's inlet (suction) pipe as can be seen in FIG. 6. Due to the presence of self-supported gaterotors, close clearance double-sided window openings substantially isolated the gaterotor housing from both the inlet and outlet ports in this pump. With the contol valves closed, the pump operated with the gaterotor housings pressurized in accordance with the subject invention's features. With the control valves open, the pump's gaterotor housings operated at inlet pressure as if it were a pump of the prior art design. The benefits of incorporating the gaterotor housing isolation feature were measured at various outlet (discharge) pressures by comparing the pump flow gage readings with the control valves open to the pump flow gage readings with the control valves closed.

Figure 7:
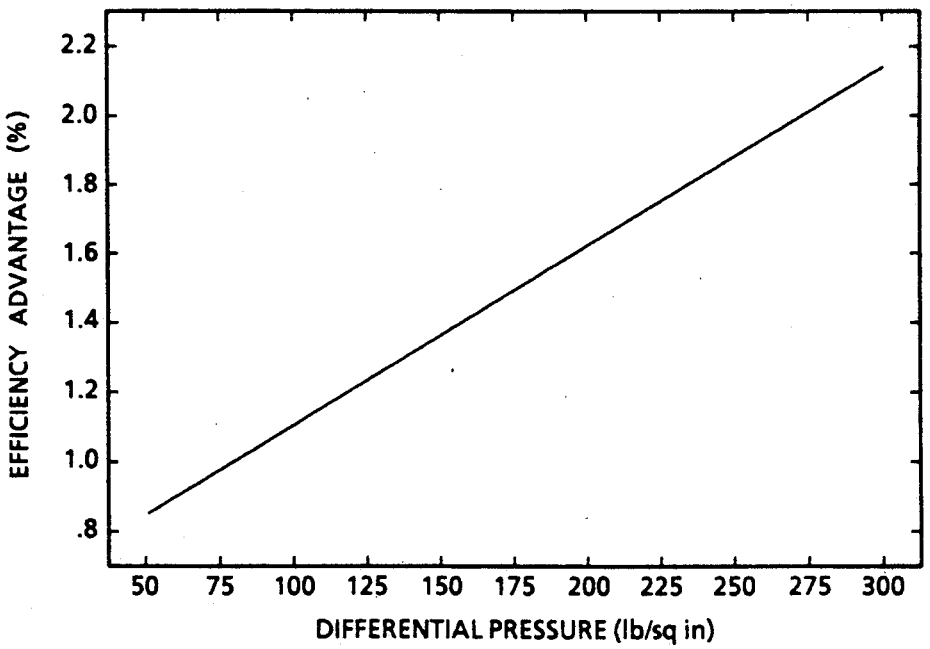
FIG. 7 is a graph of gaterotor housing isolation efficiency advantage over a single-screw pump of the prior art.

FIG. 7 shows the volumetric efficiency advantage, normalized to the prior art, of using gaterotor housing isolation in a balanced-rotor single-screw pump. The data graphed in FIG. 7 was taken pumping diesel fuel at 1,800 rev/min at 90° F. First, it should be understood that improvements to other mechanism leakage paths, for instance the paths past the gaterotor teeth, will have a greater relative impact on overall efficiency than window path leakage. Hence, while the increase in overall efficiency appears to be somewhat small, even small improvements are of significance in this field because these machines are often run for extended periods of time. Secondly, from FIG. 7, it should be recognized that the efficiency due to gaterotor housing isolation is increasing with increasing differential pressure. This is contrary to the prior art which normally reflect a decreasing efficiency with increasing operational pressures. Finally, machines which incorporate this improvement will be less expensive to manufacture, operate, and maintain.

The outstanding feature of this invention is that by selecting single-screw machine configurations which permit the use of self-supported gaterotor teeth 19, provision can be made for minimum clearances on both sides of the window opening paths 21, which when extended on at least one side of the path of gaterotor tooth insertion, substantially prevent flow between either the inlet or outlet ports and the gaterotor housing 17. This sets it apart from all of the preceding art which prevented flow between the gaterotor housing 7 and the outlet port only. The advantage of this improvement is that by so isolating the gaterotor housing 17, the enclosure's internal pressure is elevated. This internal pressurization increase, decreases the pressure differential at the window opening path 21 between the discharge chambers and the gaterotor housing and reduces leakage therefrom.

Incorporation of the dual sided seal at the window opening path 21 and providing for its extension also has another advantage - namely, that of introducing a pressure-driven gaterotor 16. In single-screw mechanisms, as a gaterotor tooth 19 travels from the gaterotor housing 17 into the mainrotor 22, the pressure in the housing acts on the gaterotor tooth's 19 trailing edge. For a pump or a compressor of the present invention, this internal pressure in the gaterotor housing 17 is greater than that in the inlet port and acts to drive the gaterotor toward engagement with the mainrotor 22. The same effect is achieved where the gaterotor tooth 19 exits the mainrotor 22 and enters the gaterotor housing 17. Here the discharge pressure acts on the gaterotor tooth's 19 trailing edge in opposition to the lower gaterotor housing intermediate pressure thereby promoting gaterotor 16 rotation into the housing 17.

It should be understood that the internal pressure in the gaterotor housing does not continue to accumulate and reach discharge levels. Some of the fluid energy stored in the form of intermediate pressure is partially expended in assisting gaterotor 16 rotation, while the bulk residual energy is dissipated by expansion into areas of the casing open to inlet. Since the internal pressure of the gaterotor housing 17 is elevated above inlet pressure in the present invention, the intermediate pressure reached in gaterotor housing 17 causes a flow rate out of the enclosure towards the inlet port area above mainrotor 22. As this flow is primarily channeled through opening path 18, a drop in pressure back to inlet levels is achieved during expansion.

Therefore, while this disclosure has focused on the fields of pump and compressor technology, and in a similar reverse manner to gas expanders, it should be understood that this invention applies to any single-screw machine configuration which permits the use of self-supported gaterotor teeth when operating on either incompressible or compressible fluids. Obviously numerous modifications and variations of the present invention are possible in light of the above teachings. It is therefore to be understood, that within the scope of the appended claims, the invention may be practiced otherwise than as specifically described herein.

What is claimed is:

1. A single screw mechanism for varying the pressure of a fluid, comprising:

a mainrotor formed with a plurality of threads;

a casing cooperating with said mainrotor threads forming at last one chamber, said casing having a fluid inlet, a fluid outlet and first and second arcoid shaped window opening paths, said first and second window openings in mutual fluid communication, said second window opening extending beyond the end of said mainrotor threads, said second window in fluid communication with said fluid inlet;

a gaterotor formed with a plurality of teeth, said teeth sequentially extending through said first window opening into said at least one chamber and cooperating with said mainrotor teeth to vary the pressure of a fluid from an inlet pressure to an outlet pressure, said gaterotor teeth further sequentially extending into said second window opening, said teeth operating at close clearances with both sides of said second window; and, a gaterotor housing sealedly cooperating with said casing and at least one surface of said gaterotor forming a gaterotor housing cavity, said cavity in operation receiving leakage fluid from said at least one chamber through said first window opening path and discharging said fluid through said second window into said inlet at a rate such that fluid pressure within said cavity achieves a steady state value intermediate between said inlet pressure and said outlet pressure.

2. A single screw compressor as claimed in claim 1 wherein said fluid discharged into said inlet flows through the teeth of of said gaterotor so as to assist the rotation of said gaterotor.

3. A single screw mechanism as claimed in claim 1 wherein said gaterotor teeth are self supporting.

4. A single screw mechanism as claimed in claim 1 wherein the sum of the subtended angles of said first and second window opening paths is equal to about 100 degrees.

* * * * *